US005675963A

United States Patent [19]

Nicholson et al.

[11] Patent Number: 5,675,963

[45] Date of Patent: Oct. 14, 1997

[54] MECHANISM FOR ACCUMULATING A STACK OF ARTICLES AND FOR THEN DROPPING THE STACK

[75] Inventors: John G. Nicholson; David L. Miller, both of Sarasota; John E. Baker, Bradenton, all of Fla.

[73] Assignee: Klockner Bartelt, Inc., Sarasota, Fla.

[21] Appl. No.: 521,829

[22] Filed: Aug. 31, 1995

[51] Int. Cl.[6] ..... B65B 35/50

[52] U.S. Cl. ..... 53/540; 53/247

[58] Field of Search ..... 53/201, 247, 250, 53/540

[56] References Cited

U.S. PATENT DOCUMENTS

| | | | |
|---|---|---|---|
| 3,670,474 | 6/1972 | Vieson et al. | 53/540 X |
| 4,709,535 | 12/1987 | Mahaffy et al. | 53/247 X |
| 4,781,011 | 11/1988 | Prakken | 53/247 X |
| 4,875,328 | 10/1989 | Meyer | 53/247 X |
| 5,117,614 | 6/1992 | Johnsen | 53/247 X |

*Primary Examiner*—Linda Johnson

*Attorney, Agent, or Firm*—Leydig, Voit & Mayer, Ltd.

[57] ABSTRACT

The mechanism includes a pair of gates which are horizontally spaced from one another and which are operable to stroke between inwardly extended and outwardly retracted positions for collecting and dropping the articles, respectively. The gates are mounted on a threaded member for selective horizontal adjustment of the distance between the gates to enable collection of articles of various widths. As an incident to adjusting the distance between the gates, the stroke of the gates is simultaneously adjusted.

9 Claims, 4 Drawing Sheets

MECHANISM FOR ACCUMULATING A STACK OF ARTICLES AND FOR THEN DROPPING THE STACK

FIELD OF THE INVENTION

This invention relates generally to a mechanism for receiving individually delivered articles, for accumulating a predetermined number of the articles into a stack, and for then transferring the stack of articles. More particularly, the invention relates to a mechanism adapted to collect falling articles and to then drop the stack of articles.

BACKGROUND OF THE INVENTION

A mechanism of this type is particularly useful in one type of packaging machine adapted to package a predetermined number of relatively flat articles such as pouches filled with a food product and having a particular width. In such a machine, the articles are delivered to the mechanism at a predetermined rate from a conveyor belt which is located above but horizontally spaced from the mechanism. The articles fly from the end of the conveyor belt in a generally horizontal direction but having a downwardly angled trajectory. The mechanism collects the articles into a stack and then drops the stack into a bucket on a lower conveyor belt. The lower conveyor belt carries the stack of articles to a packaging station whereupon the stack is packaged into a box or carton.

One mechanism of this type utilizes so-called trap doors or drop gates for collecting the articles. The gates are horizontally spaced from one another and are adapted to operate between inwardly extended and outwardly retracted positions. In the extended position, the gates approach one another and engage the underside of a first article inwardly from two oppositely located edges of the article to support the accumulation of additional articles on the first article. The distance between the gates of such mechanisms is typically adjustable to enable collection of articles of different widths.

During normal operation of such a mechanism, the gates cycle between the extended and retracted positions at a predetermined rate. The articles collect on the gates for a predetermined count during which the gates are in the extended position. As the gates retract outwardly past the edges of the articles, the stack of articles drops into the bucket. Following a predetermined dwell after the stack has dropped, the gates return to the extended position to catch the next article and to begin accumulating another stack. In order to prevent additional articles from falling into the bucket after the stack has dropped, the delivery rate of the articles is timed to allow the gates to return to the extended position, or to at least sufficiently return so as to enable the gates to catch and support the next article. As a result, the delivery rate of the articles is limited, in part, by the dwell time of the gates in the retracted position.

To provide for maximum operating speed of such a mechanism, the horizontal stroke of the gates must be adjusted for the particular width of the articles to be collected. More specifically, the stroke of the gates inwardly from the edges of the articles must be minimized but yet sufficient to provide for adequate support of the articles. The stroke outwardly beyond the edges of the articles must be kept to a minimum so as to minimize the dwell time of the gates in the retracted position. Minimizing the stroke of the gates in this way enables the cycle rate of the mechanism to be maximized for each of various sizes of articles and generally enables the mechanism to run at a faster rate as the width of the articles decreases.

Prior mechanisms of this type are not easily adjusted for the collection of articles of various widths. For example, in one prior mechanism the gates are mounted on blocks which are secured to a frame with threaded fasteners. To change the distance between the gates of this mechanism, the fasteners must be loosened or removed, the blocks relocated on the frame, and the fasteners tightened or reinstalled so as to secure the blocks in the new position. The stroke of the gates must then be adjusted separately after the position of the gates has been adjusted. As a result, substantial setup or changeover time is required to adjust such mechanisms for the collection of articles of a particular width and still further time is required to maximize the operating speed of the mechanism for the collection of those articles.

SUMMARY OF THE INVENTION

The general aim of the present invention is to provide a new and improved mechanism having gates adapted to collect a stack of articles and to then drop the stack, the mechanism being more quickly and easily adjusted for the collection of articles of various sizes when compared to prior mechanism of the same general type.

A more detailed objective is to achieve the foregoing by providing screw means for selectively adjusting the horizontal distance between the gates.

Another aim of the invention is to provide for simultaneous adjustment of the horizontal stroke of the gates and the distance between the gates according to a predetermined relationship so as to minimize the stroke for a particular size of article and to, therefore, maximize the operating speed capacity of the mechanism for collection of articles of that size.

It is a feature of the invention that a pair of gates are pivotally mounted on respective carriages, and a linkage, pivotally mounted on the frame, has operative ends connected to the gates. The operative ends of the linkage have a sliding connection to the gates for both allowing horizontal adjustment of the gates and automatically adjusting the deployed position of the gates as a function of the width of the packages being collected.

In summary, it is a feature of the invention that a pair of carriages are adjusted with respect to a machine center line to adjust for the width of the pouch, and adjustment of the carriages adjusts the length of a sliding link, which in turn adjusts the stroke of the gates so that the length of the gate stroke is automatically adjusted as a function of package width, to eliminate wasted gate stroke while achieving optimum article support.

These and other objects and advantages of the invention will become more apparent from the following detailed description when taken in conjunction with the accompanying drawings.

Figure 1:
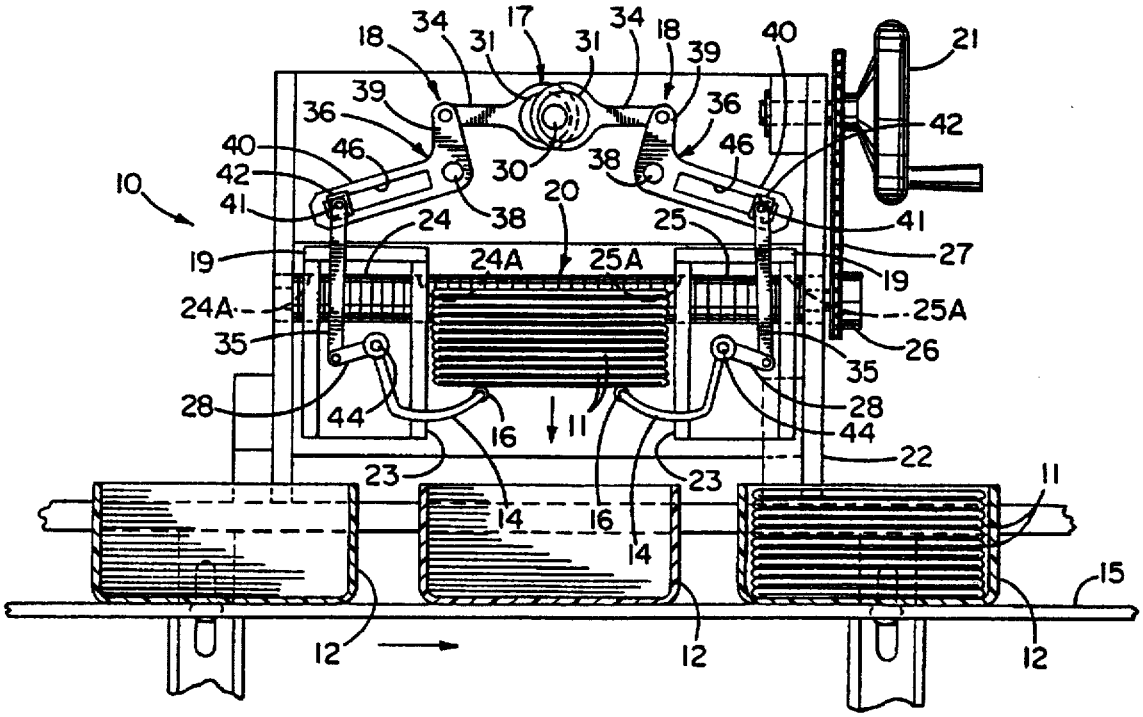
FIG. 1 is a front view of a new and improved machine incorporating the unique features of the present invention, and shows certain parts supporting a stack of articles, and buckets on a conveyor belt for receiving the articles.

While the invention is susceptible of various modifications and alternative constructions, certain illustrated embodiments hereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENTS

For purposes of illustration, the present invention is shown in the drawings as embodied in a machine 10 (FIG. 1) for receiving relatively flat articles such as pouches 11 filled with a food product, for collecting a predetermined number of the pouches into a stack, and for then dropping the stack of pouches into a container such as a bucket 12 on a conveyor belt 15.

During normal operation of the machine 10, a supply of pouches 11 is delivered to the machine at a predetermined rate. The pouches fall through a predetermined and downwardly angled trajectory and collect on a pair of horizontally separated gates 14 which are adapted to stroke between extended and retracted positions. In the extended or active position as shown in FIG. 1, free end portions of the gates extend inwardly toward one another from two oppositely located edges of the pouches. The gates are adapted to engage the underside of a first pouch along a substantial length of the pouch so as to support an accumulating stack of pouches as additional pouches drop onto the first pouch. Typically, the pouches are somewhat flexible and, as a general rule, it has been found that supporting the first pouch inwardly from each of the edges of the pouch at a distance approximately 20% to 30% of the width of the pouch provides for relatively stable support of the accumulating stack of pouches.

Figure 2:
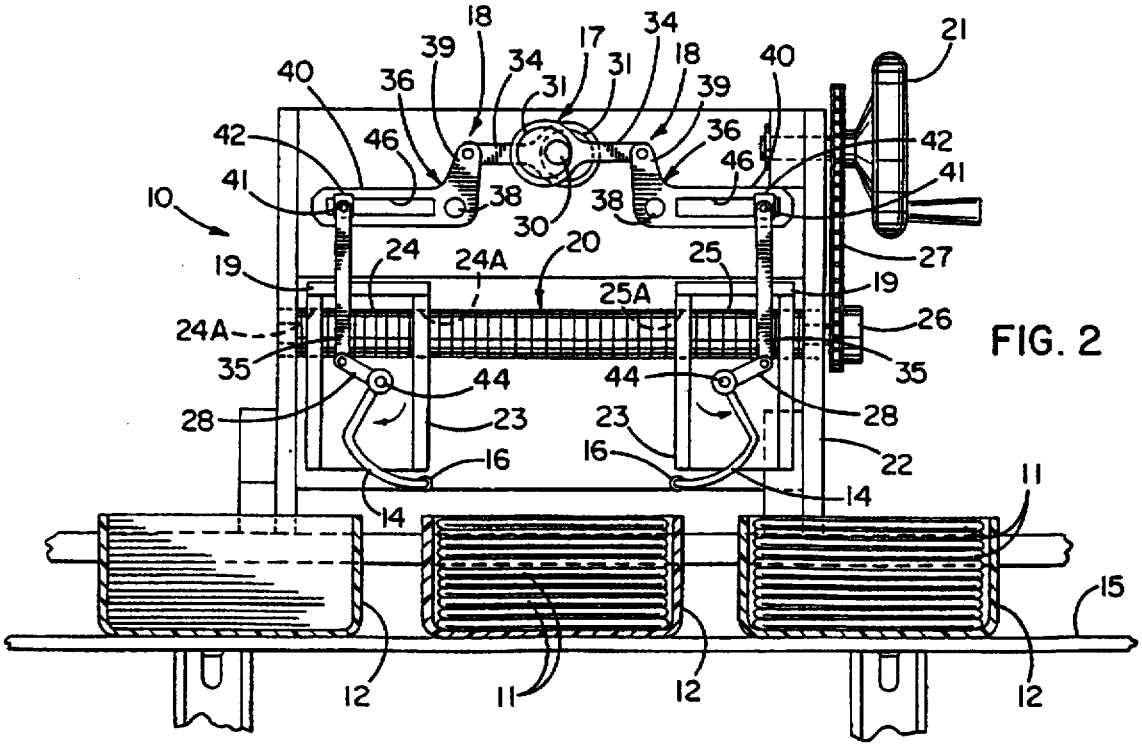
FIG. 2 is a view similar to FIG. 1 but shows the position of the parts after the articles have been released.
Figure 3:
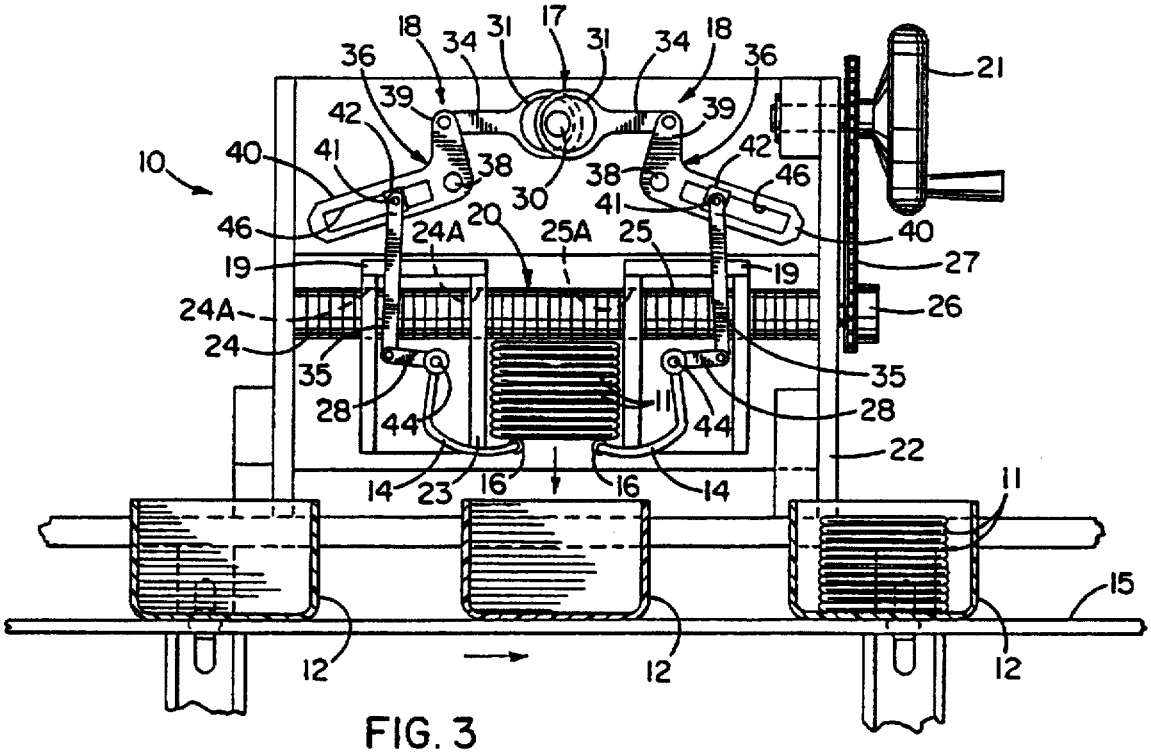
FIGS. 3 and 4 are views similar to FIGS. 1 and 2, respectively, but show the position of the parts in relation to smaller articles.

The machine 10 includes a drive mechanism 17 adapted to produce an oscillating output motion and actuating mechanisms 18 operably connected between the drive mechanism and the gates 14 for cycling the gates between the extended and the retracted positions. During each cycle, the pouches 11 collect on the gates for a predetermined count during which the gates are in the extended position. As the gates retract outwardly past the edges of the pouches to an inactive position, the stack of pouches drops into the bucket 12 as shown in FIG. 2. Following a predetermined dwell after the stack has dropped, the gates return to the extended position so as to catch the next pouch and to begin accumulating another stack. Before the gates are again retracted, the conveyor belt 15 advances to bring the next bucket into alignment with the gates for receiving the next stack of pouches.

In accordance with one aspect of the invention, setup means are provided for adjusting the carriages 19 with respect to the center line of the machine, thereby to adjust the mechanism for different size pouches. In the illustrated embodiment, the setup means include a drive screw 20 connected to a hand crank 21, adapted to selectively adjust the distance between the carriages and the center line of the machine as the hand crank is turned. Accordingly, the distance between the gates is quickly and easily adjusted for the collection of pouches 11 having a particular width.

More specifically, the drive screw 20 is journaled in a frame 22 and is formed with left-hand and right-hand threaded end portions 24 and 25, respectively. One of the carriages 19 is formed with an opening 24A having left-handed threads which receive the left-hand threaded portion of the drive screw. The other carriage is formed with an opening 25A having right-handed threads which receive the right-hand threaded portion of the drive screw. A sprocket 26 engaging a drive chain 27 is secured to one end of the drive screw. The hand crank 21 is journaled in the frame and is equipped with a second sprocket engaging the drive chain. With this arrangement, the carriages translate along the drive screw and toward one another as the hand crank rotates the drive screw in one direction. Alternately, as the drive screw is rotated in the opposite direction, the carriages recede from one another. The size and the pitch of the left-hand and right-hand threaded end portions of the drive screw are identical so that the carriages can be initially located and will remain equally spaced from the center of the pouches 11. As a result, the distance between the gates is quickly and easily adjusted for supporting various widths of pouches, preferably approximately ¼ of the way in from the edges of the pouches.

Further in accordance with the invention, the actuating mechanisms 18 are uniquely adapted to automatically adjust the stroke of the gates 14 in response to adjustment of the distance between the gates. To this end, the actuating mechanisms are equipped with sliding connections adapted to translate with the gates so as to adjust the length of lever arms in the actuating mechanisms as the distance between the gates is adjusted. Moreover, the actuating mechanisms are configured so that there is a predetermined relationship between the length of these lever arms and the stroke of the gates.

In the preferred embodiment, the retracted position of the gates is constant relative to the carriages and the horizontal stroke of the gates from the retracted position is maintained approximately equal to ¼ of the distance between the free end portions of the gates when the gates are in the retracted position. Accordingly, the gates are automatically provided with the minimum stroke which is necessary to clear the edges of the pouches 11 after the gates have been adjusted to support the pouches ¼ of the way in from the edges when in the extended position.

Figure 6:
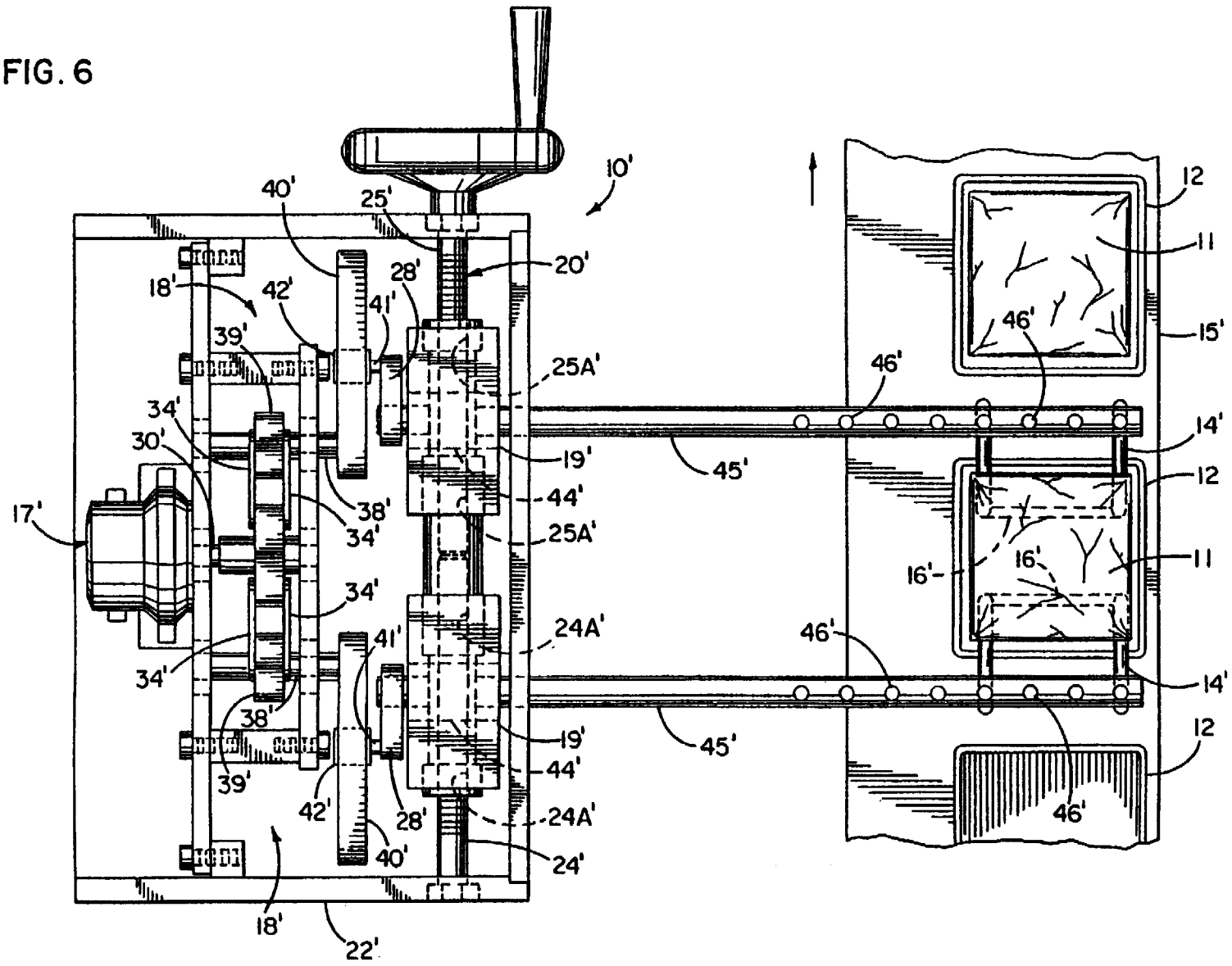
FIG. 6 is a top view of the machine of the alternate embodiment as seen in the direction of the arrows of the line 6—6 of FIG. 5.

In carrying out the invention, the gates 14 are mounted on pivots 44 which, in turn, are secured to the carriages 19. The gates are adapted to swing between the retracted and the extended positions in response to substantially vertical driving oscillations supplied to link rods 28. The link rods extend outwardly from the pivots and are secured to the gates for swinging with the gates. In the retracted position, the gates extend generally downwardly from the pivots and then curve inwardly toward one another such that the free end portions of the gates are located inwardly of the pivots. When the link rods are driven downwardly, the gates swing upwardly and inwardly to the extended position so as to engage the underside of the first pouch 11 of a stack. In the embodiments shown, each of the gates is formed with two curved fingers (see FIG. 6) and a support rod 16 which extends between the free end portions of the fingers. As the gates swing from the retracted position to the extended position, the support rods swing through arcs which are centered at the pivots. With this arrangement, the horizontal stroke of the gates is equal to the horizontal component of these arcs and establishes the locations of support for the pouches 11 inwardly from each of the edges of the pouches.

The drive mechanism 17 is mounted on the frame 22 above the gates 14 but is horizontally offset from the gates so as to allow the pouches 11 to drop onto the gates. The drive mechanism shown in FIG. 1 is an eccentric type drive which includes an output shaft 30 and two offset cams 31. The cams are formed with circular cross-sections and are secured to the shaft such that the centers of the cams are aligned with the center of the shaft but are offset from one another by 180 degrees. When the shaft rotates at a constant speed, the cams are operable to oscillate horizontally between first and second positions as shown in FIGS. 1 and 2, respectively.

In general, the actuating mechanisms 18 are located on either side of the drive mechanism 17 and extend between the drive mechanism and the link rods 28. The actuating mechanisms are adapted to transform the oscillating output of the drive mechanism into generally vertical and phased oscillations for simultaneously driving the gates between the retracted and the extended positions.

More specifically, the actuating mechanisms 18 include drive links 34 connected to the drive mechanism 17, connecting rods 35 connected to the link rods 28, and bell cranks 36 connected between the drive links and the connecting rods. The bell cranks are mounted on pivots 38 which are secured to the frame 22. The bell cranks are formed with link arms 39 which extend generally upwardly from the pivots 38 and with intermediate driver arms 40 which extend generally horizontally and outwardly from the pivots 38. The drive links extend generally horizontally and are operably connected between the drive mechanism and the link arms. Specifically, the cams 31 of the drive mechanism are journaled in end portions of the drive links and oppositely located end portions of the drive links are pivotally connected to the link arms. The connecting rods extend generally vertically from and are pivotally connected to the intermediate driver arms as indicated at 41. Lower end portions of the connecting rods are pivotally connected to link rods. With this arrangement, the intermediate driver arms oscillate generally vertically through a predetermined angle in response to generally horizontal oscillation of the drive links and the connecting rods transfer the vertical oscillations of the intermediate driver arms to the link rods for driving the gates 14 between the retracted and the extended positions.

In further carrying out the invention, the connections 41 between the connecting rods 35 and the intermediate driver arms 40 are adapted to translate as the gates 14 are adjusted for pouches 11 of various widths. To this end, slider blocks 42 carry the connections 41 and are slidably located in elongated slots 46 formed in and extending outwardly in the intermediate driver arms. When the position of the carriages 19 is adjusted along the drive screw 20, the lower end portions of the connecting rods translate with the carriages and pull the slider blocks in the slots 46 and in the same direction as the carriages.

During normal operation of the machine 10, the connections 41 swing generally upwardly and downwardly through an arc-length which is determined by the predetermined angular movement of the intermediate driver arms 40 and by the length of the lever arm between the connections 41 and the pivots 38. When the gates 14 are adjusted toward one another and the slider blocks 42 slide toward the pivots 38, the arc-length of travel of the connections 41 decreases since the length of the lever arm decreases. Similarly, the arc-length of travel of the connections 41 increases as the gates are adjusted away from one another since the length of the lever arm increases. Moreover, the travel of the lower portions of the connecting rods is substantially equal the arc-length of travel of the connections 41. Accordingly, when the gates are adjusted away from one another for the collection of wider pouches, the horizontal stroke of the gates automatically increases according to a predetermined relationship between the length of the lever arm acting on the connections 41 and the angular stroke of the gates such that the support rods reach further inwardly from the edges of the wider pouches. Similarly, the angular stroke of the gates automatically decreases when the gates are adjusted toward one another for the collection of smaller pouches.

Figure 4:
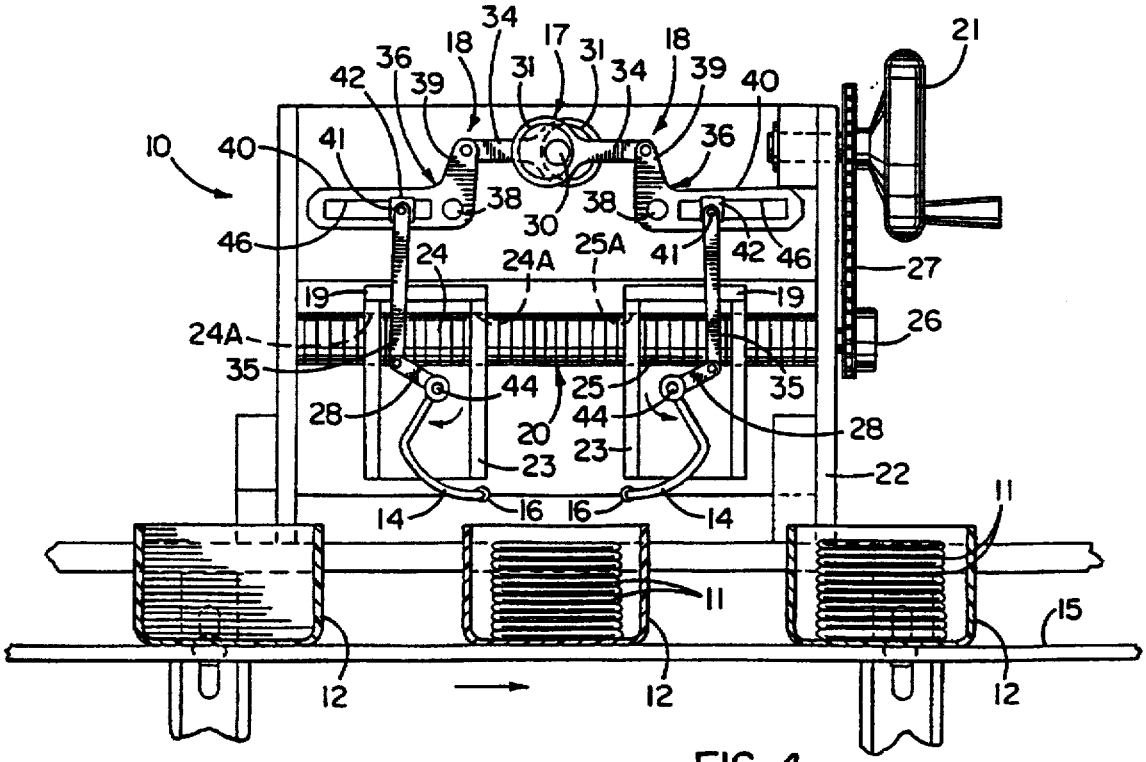

In the preferred embodiment, the slot 46 is adapted to pivot between a generally horizontal position as shown in FIG. 1 and a downwardly sloping position as shown in FIG. 2, the horizontal position of the slot 46 corresponding to the retracted position of the gates 14. As a result, and as can best be understood by comparing FIGS. 2 and 4, the absolute angular position of the gates in the retracted position does not change when the horizontal distance between the gates is adjusted. Advantageously, this arrangement enables the support rods 16 to be located below and generally vertically aligned with inner vertically extending sides 23 of the carriages 19 when the gates are in the retracted position so that the sides 23 aid in guiding and aligning the pouches as they drop onto the gates.

Moreover, in the preferred embodiment, the predetermined relationship between the length of the lever arm acting on the connections 41 and the angular stroke of the gates 14 establishes and maintains the horizontal stroke of the gates at approximately equal to ¼ of the horizontal distance between the support rods 16 when the gates are in the retracted position. As the distance between the gates is adjusted and the slider blocks 42 simultaneously slide in the slots 46, the horizontal stroke of the gates will change by a distance equal to ¼ of the change in the distance between the gates. Accordingly, if the gates are positioned so as to support the pouches 11 at ¼ of the way in from the edges, the gates will just clear the edges of the pouches in the retracted position and the stroke of the gates beyond the edges of the pouches will be relatively small. Alternately stated, if the support rods are positioned to just clear the edges of the pouches when the gates are in the retracted position, the gates will automatically support the pouches approximately ¼ of the way in from the edges and the stroke in the retracted position beyond the edges of the pouches will be minimal.

Those familiar with the art will appreciate that the foregoing arrangement establishes the retracted position of the gates 14 as a datum and that the change in stroke resulting from adjusting the horizontal distance between the gates affects only the angular position of the gates in the extended position. In a machine (not shown) adapted to utilize a modified embodiment of the invention, the change in stroke could as well be added to or subtracted from the retracted position of the gates, or from other similarly actuated members, by positioning those members in an extended position when the slots 46 are in the horizontal position. Alternately, the horizontal position of the slots could be set to correspond to an angular position between the extended and the retracted positions.

Figure 5:
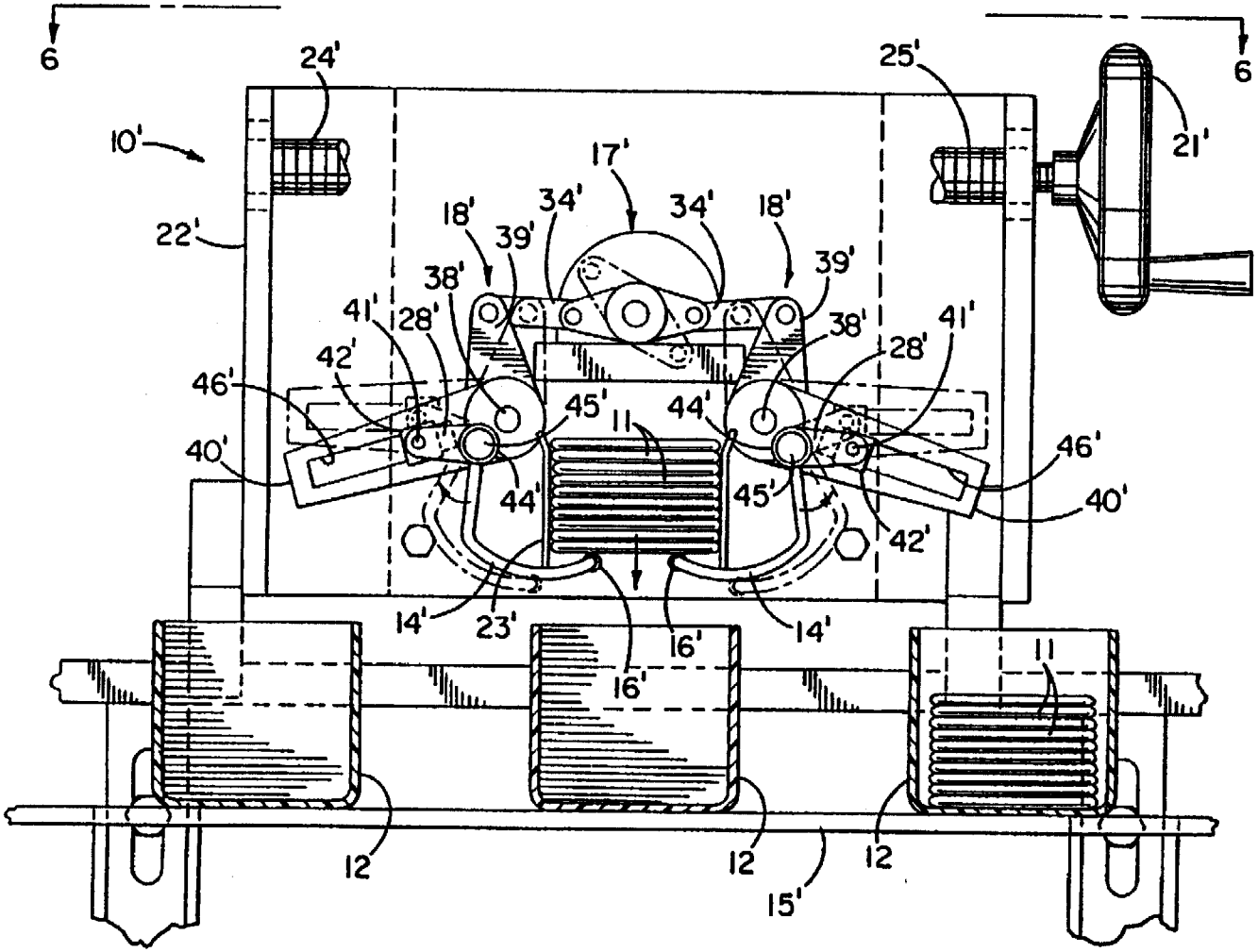
FIG. 5 is a view similar to FIG. 1 of an alternate embodiment and shows the position of certain parts in phantom lines after the articles have been released.

In an alternate embodiment shown in FIG. 5, the components of the machine 10' have been identified with primed numbers which correspond to the components of the machine 10. In this instance, the drive mechanism 17' utilized is an air powered actuator adapted to oscillate between horizontal and approximately 43 degrees from one side of horizontal. The actuating mechanisms 18' have been generally modified so as to be relatively compact. To this end, the connecting rods 35 of the embodiment shown in FIGS. 1–4 have been eliminated, the link arms 39' and the intermediate driver arms 40' have been separated (see FIG. 6) and the slider blocks 42' are directly and pivotally connected to the link rods 28'. Advantageously, these relatively compact actuating mechanisms enable multiple sets of independently driven and actuated gates 14' to be vertically stacked so as to time the dropping of stacks of pouches 11 into buckets 12 on a continuous motion conveyor belt 15'. For example, three sets of gates are stacked in a so-called triple tier or triple drop machine (not shown). In this case, the upper pair of gates might be timed to alternately collect and drop stacks having two and then three pouches. The middle pair of gates might be timed to collect two drops from the upper gates so as to collect and then drop stacks having five pouches. The lower gates would then be timed for releasing the stack of five pouches into a bucket as the bucket passes under the gates.

In the machine 10', the gates 14' are secured near the ends of cantilever or elongated rods 45' (FIG. 6) so as to position the gates remote from the actuating and drive mechanisms 17' and 18', respectively. Advantageously, the rods may be formed with longitudinally spaced holes 46' for selectively positioning the gates along the rods. This arrangement facilitates clean-up and maintenance of the drive and actuating mechanisms by virtue of their remote location from the conveyor belt 15'. In addition, this arrangement is particularly useful to prevent contamination of the product in the pouches 11 by oil or other fluids in and around the actuating and drive mechanisms.

From the foregoing it will be apparent that the present invention brings to the art a new and improved machine 10, 10' which is quickly and easily adjusted for collecting and for then dropping stacks of pouches 11 of various widths. The distance separating the gates is adjusted by simply turning a hand crank 21 and the uniquely configured actuating mechanisms 18, 18' are adapted to maintain a predetermined and preferably proportional relationship between the stroke of the gates 14 and the distance separating the gates. In the preferred embodiment, when the distance between the gates is adjusted to support pouches of a particular width at ¼ of the way in from the edges of the pouches, the stroke of the gates is simultaneously adjusted so as to provide for sufficient stroke to clear the edges of the pouches while keeping the total stroke to a minimum. By virtue of such adjustment, the machine is automatically operable to run at the maximum speed capacity for pouches of that size.

What is claimed is:

1. Apparatus for first accumulating a stack of articles and for then releasing the stack, said apparatus comprising a support, a pair of carriages mounted on said support for horizontal adjustment toward and away from one another, setup means connected between said support and said carriages for effecting selective horizontal adjustment of said carriages, a gate mounted on each of said carriages for swinging through a predetermined angular stroke between an active position holding said stack and an inactive position releasing said stack, and linkage means adjustable by horizontal adjustment of said carriages for adjusting the stroke of said gates, said linkage means being operable to shorten the stroke of said gates when said carriages are adjusted toward one another and to lengthen the stroke of said gates when said carriages are adjusted away from one another.

2. Apparatus as defined in claim 1 in which said setup means includes a horizontally extending screw member mounted on said support for rotation relative to said support, said screw member having a first end portion formed with left-handed threads and having a second end portion formed with right-handed threads, one of said carriages being formed with a left-hand threaded opening receiving said first end portion, the other of said carriages being formed with a right-hand threaded opening receiving said second end portion.

3. Apparatus as defined in claim 1 in which said linkage means includes a pair of pivots mounted on said support and a link member mounted on each of said pivots for swinging through a second predetermined angular stroke, said linkage means further including means for slidably connecting said gates to said link members such that said setup means causes said connecting means to approach and recede from said pivots as said carriages are adjusted toward and away from one another, respectively.

4. Apparatus as defined in claim 3 in which said connecting means translate generally horizontally when the position of said carriages is adjusted while said gates are in the inactive position, thereby to define a constant inactive position of the gates with respect to the carriages for all horizontal positions of said carriages.

5. Apparatus as defined in claim 3 in which said link members are formed with slots extending from said pivots, said connecting means including slider blocks slidably received in said slots and pivotally connected to said gates.

6. A stacker comprising:

a frame;

a pair of horizontally spaced carriages connected to the frame;

means for concurrently adjusting the horizontal position of the carriages toward or away from one another;

gates pivotally mounted on the respective carriages, each gate swinging through a stroke between a retracted position in which the gate is clear of the carriage and an extended position in which the gates extend between the carriages;

a drive mounted on the frame;

a linkage pivotally mounted on the frame and having drive ends connected to the drive and operative ends connected to the gates; and the operative ends of the linkage having a sliding connection to the gates for (a) allowing horizontal adjustment of the carriages, and (b) automatically shortening and lengthening the stroke as the carriages are adjusted toward and away one another, respectively.

7. A stacker as defined in claim 6 in which the gates include support surfaces which swing upwardly and inwardly toward one another as the gates move to the extended position.

8. A stacker as defined in claim 7 in which the operative ends of the linkage have a constant horizontal position to define a constant retracted position for the gates with respect to the carriages.

9. A stacker as defined in claim 8 in which the distance between the support surfaces in the extended position is maintained at approximately equal to one-half the distance between the support surfaces in the retracted position.

* * * * *